US008522376B2

(12) United States Patent
Rohr et al.

(10) Patent No.: US 8,522,376 B2
(45) Date of Patent: Sep. 3, 2013

(54) CAPTIVE CORNER MATTRESS-RETENTION MECHANISM

(75) Inventors: William Robert Rohr, Joplin, MO (US); Jake Neuenswander, Carthage, MO (US); Chad Baker, Georgetown, KY (US); Jay Thompson, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 13/353,911

(22) Filed: Jan. 19, 2012

(65) Prior Publication Data

US 2013/0185868 A1 Jul. 25, 2013

(51) Int. Cl.
*A47C 21/02* (2006.01)

(52) U.S. Cl.
USPC ..... 5/411; 5/692; 5/739

(58) Field of Classification Search
USPC ..... 5/193, 411, 692, 739
See application file for complete search history.

(56) References Cited

U.S. PATENT DOCUMENTS

| | | | | | |
|---|---|---|---|---|---|
| 3,350,726 | A | * | 11/1967 | Gardner | 5/411 |
| 4,017,919 | A | * | 4/1977 | Hemmeter | 5/411 |
| 4,199,831 | A | * | 4/1980 | Muller | 5/411 |
| 5,218,729 | A | * | 6/1993 | Walton | 5/504.1 |
| 5,628,080 | A | * | 5/1997 | Quintile | 5/663 |

* cited by examiner

*Primary Examiner* — Michael Trettel
(74) *Attorney, Agent, or Firm* — Shook, Hardy & Bacon L.L.P.

(57) ABSTRACT

A mechanism for securing a mattress on an automated bed is provided. More particularly, the invention relates to a mattress-retention mechanism for preventing a mattress from moving towards the foot end of a bed during articulation. The mattress-retention mechanism includes a mattress-support structure adapted to support a corner of a mattress, with a portion of the mattress-support structure having a curved interior surface. The mattress-support mechanism also includes a foundation attachment surface for removably attaching the mattress-retention mechanism to the top of a mattress foundation, where the foundation attachment surface is perpendicular to the curved interior surface. The mechanism may include a bedding aperture on the side of the mattress-support structure to accommodate bedding inserted through the bedding aperture. Further, the mechanism may include a side attachment surface for removably attaching the mattress-retention mechanism to a vertical side of the mattress foundation.

20 Claims, 5 Drawing Sheets

CAPTIVE CORNER MATTRESS-RETENTION MECHANISM

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention generally relates to a mechanism for securing a mattress on an automated bed. More particularly, the invention relates to a mattress-retention mechanism for preventing a mattress from moving towards the foot end of an automated bed during articulation.

BACKGROUND OF THE INVENTION

A variety of methods are used to prevent a mattress from shifting past the edge of an automated bed foundation. Traditional mattress-retention methods include foot retainer bars, snaps, zippers, buckles, bars, Velcro®, clips, pockets, and non-slip fabrics or surfaces. Many of these methods help prevent a mattress from moving towards the foot end of an automated bed during base articulation, such as during articulation of a Power Foundation from Leggett & Platt®. However, these retention methods require modifications to the mattress itself and/or parts of the automated bed in order to reduce or eliminate forward, foot-end motion during articulation. Additionally, such methods may be unsightly to a user, and may complicate the use of traditional bedding materials such as sheets or blankets on the bed.

Accordingly, a need exists for a reliable mattress-retention mechanism for use with an automated bedding system, which addresses the foregoing and other problems.

BRIEF SUMMARY OF THE INVENTION

The present invention generally relates to a mattress-retention mechanism that prevents a mattress from moving towards the foot end of an automated bed during articulation. In one embodiment, a mattress-retention mechanism is cast from a single mold and secured to the corner of a bed foundation. In another embodiment, a mattress-retention mechanism may include two or more parts, separately molded, that together perform the function of capturing a corner of a mattress during articulation. Accordingly, the mattress-retention mechanism "captures" the corner of the mattress and prevents it from shifting past the edge of the foundation. As will be understood, two mattress-retention mechanisms may be secured to a single foundation, thereby capturing both corners at the foot end of a mattress during articulation.

One illustrative embodiment of a mattress-retention mechanism comprises a mattress-support structure adapted to support the corner of a mattress, with a portion of the mattress-support structure having a curved interior surface. The mattress-retention mechanism includes a foundation attachment surface for removably attaching the mattress-retention mechanism to the top of a mattress foundation, where the foundation attachment surface is perpendicular to the curved interior surface.

In another illustrative aspect, a mattress-retention mechanism comprises an upper retaining component and a lower retaining component. The upper retaining component includes: (1) a mattress-support structure adapted to support the corner of a mattress, where a portion of the mattress-support structure has a curved interior surface, and (2) a foundation attachment surface perpendicular to the curved interior surface, where the foundation attachment surface includes a lock component imbedded in the lower surface of the foundation attachment surface. The lower retaining component comprises a socket component that protrudes from the top surface of the lower retaining component. The lower retaining component is removably attached to the top of a mattress foundation. The socket component of the lower retaining component is capable of mating with the lock component of the foundation attachment surface, thereby coupling the upper retaining component to the lower retaining component.

According to a third illustrative aspect, the present invention includes a mattress-retention mechanism comprising a mattress-support structure adapted to support the corner of a mattress, with a portion of the mattress-support structure having a curved interior surface that conforms to the curve of the vertical side of the mattress. The mattress-retention mechanism also includes a foundation attachment surface for removably attaching the mattress-retention mechanism to the top of a mattress foundation, where the foundation attachment surface is perpendicular to the curved interior surface of the mattress-support structure. The mattress-retention mechanism also includes a bedding aperture positioned on the side surface of the mattress-support structure. The bedding aperture is adapted to accommodate bedding inserted through the bedding aperture.

Additional objects, advantages, and novel features of the invention will be set forth in part in the description which follows, and in part will become apparent to those skilled in the art upon examination of the following, or may be learned by practice of the invention.

BRIEF DESCRIPTION OF SEVERAL VIEWS OF THE DRAWING

The present invention is described in detail below with reference to the attached drawing figures, wherein.

DETAILED DESCRIPTION OF THE INVENTION

Figure 1:
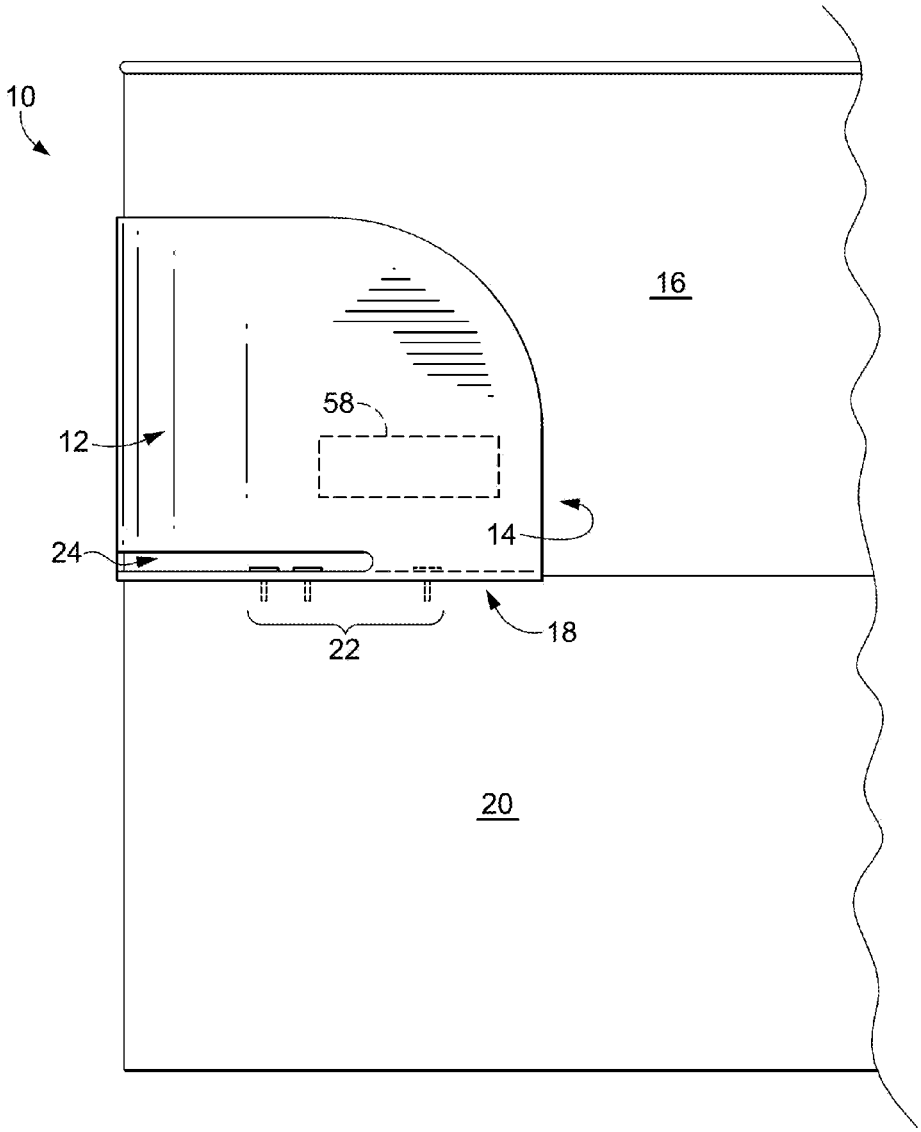
FIG. 1 is a side view of a mattress-retention mechanism.

An embodiment of a mattress-retention mechanism 10 is seen in FIGS. 1 and 2A-D. Referring first to FIG. 1, a side view of an exemplary mattress-retention mechanism 10 includes a mattress-support structure 12 having a curved interior surface 14 that conforms to the vertical, curved corner of a mattress 16. Embodiments of the mattress-retention mechanism 10 include an identifying marking 58 molded into the exterior surface of the mattress-support structure 12. The mattress-support structure 12 includes a foundation attachment surface 18 that can be used to couple the mattress-retention mechanism 10 to a mattress foundation 20 using one or more of the attachment mechanisms 22. Although the attachment mechanisms 22 in FIG. 1 are depicted as being screws viewed from the side, a variety of types of attachment mechanisms 22 may be used to couple the mattress-retention mechanism 10 to the mattress foundation 20, including posts, pegs, bolts, hooks, or other devices.

In embodiments, once secured to the corners of a mattress foundation 20, a pair of mattress-retention mechanisms 10 is used to capture the corners of a mattress 16 during articulation. With a first mattress-retention mechanism 10 coupled to a first foot-end corner of the mattress foundation 20, and a second mattress-retention mechanism 10 coupled to the second foot-end corner of the mattress foundation 20, the mattress 16 is prevented from moving towards the foot end of the bed during articulation. In one embodiment, a mattress-retention mechanism 10 is cast from a single mold and secured to the corner of a mattress foundation 20. In another embodiment, a mattress-retention mechanism 10 may include two or more parts, separately molded, that together perform the function of capturing a corner of a mattress 16 during articulation. Embodiments of a mattress-retention mechanism 10 may be constructed from plastic, metal, or any other material that can maintain the shape of the mattress-retention mechanism 10 while restricting the movement of a mattress 16 during articulation.

In addition to preventing the mattress 16 from moving towards the foot end of a bed during articulation, the mattress-retention mechanism 10 also includes a bedding aperture 24 on the side surface of the mattress-support structure 12 that may be used to retain bedding on the mattress 16. As depicted in FIG. 1, the bedding aperture 24 is an opening in the vertical side of the mattress-support structure 12 that is adapted to accommodate bedding inserted through the bedding aperture 24. For example, the corner edge of a fitted bed sheet may be inserted into the bedding aperture 24 to secure the bed sheet to the mattress 16. In one embodiment, the mattress-retention mechanism 10 may be positioned in direct contact with the mattress 16, with bedding for the mattress 16 secured around the corner of the mattress 16 (and around the mattress-retention mechanism 10) and into the bedding aperture 24. In other embodiments, a fitted sheet may be applied directly to the mattress 16, with the mattress-retention mechanism 10 securing both the mattress 16 and the fitted sheet. In that example, additional bedding may still be inserted into the bedding aperture 24.

Figure 2A:
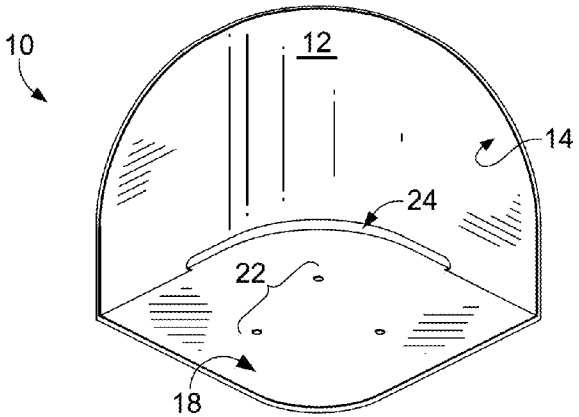
FIG. 2A is an interior perspective view of the mattress-retention mechanism of FIG. 1.

Additional views of the mattress-retention mechanism 10 are depicted in FIGS. 2A-2D. FIG. 2A is an interior perspective view of an exemplary mattress-retention mechanism 10, including a curved interior surface 14 of the mattress-support structure 12 that abuts the vertical side of a mattress 16. The top of the foundation attachment surface 18 is depicted in FIG. 2A as including a plurality of attachment mechanisms 22. In one embodiment, attachment mechanism 22 includes one or more apertures in the surface of the foundation attachment surface 18 that can be used to attach the mattress-retention mechanism 10 to the mattress foundation 20.

Figure 2B:
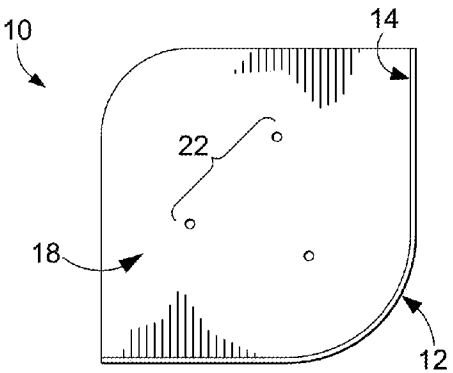
FIG. 2B is a top view of the mattress-retention mechanism of FIG. 1.

FIG. 2B is a top view of the mattress-retention mechanism of FIG. 1, which demonstrates that the mattress-support structure 12 has a thickness and a curved interior surface 14. In some embodiments, the thickness of the mattress-support structure 12 is within the range of 0.09 to 1.3 inches. In some embodiments, as curved to accommodate the vertical corner of a mattress 16, the internal radius of the curved interior surface 14 is approximately 2.5 inches.

Figure 2C:
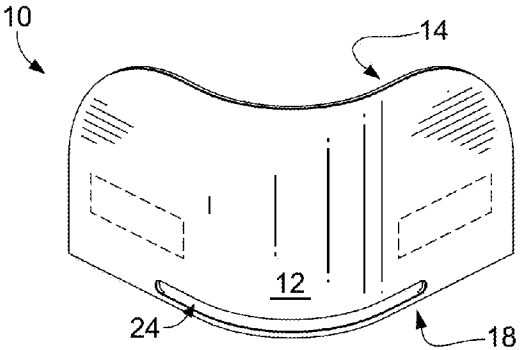
FIG. 2C is an exterior perspective view of the mattress-retention mechanism of FIG. 1.

The curved exterior of the mattress-support structure 12 is best seen in FIG. 2C, which is an exterior perspective view of the mattress-retention mechanism 10 of FIG. 1. In embodiments, bedding aperture 24 is an opening in a portion of the curved, vertical side of the mattress-support structure 12. Accordingly, the size of bedding aperture 24 may be adapted to accommodate various types of bedding inserted through the bedding aperture 24.

Figure 2D:
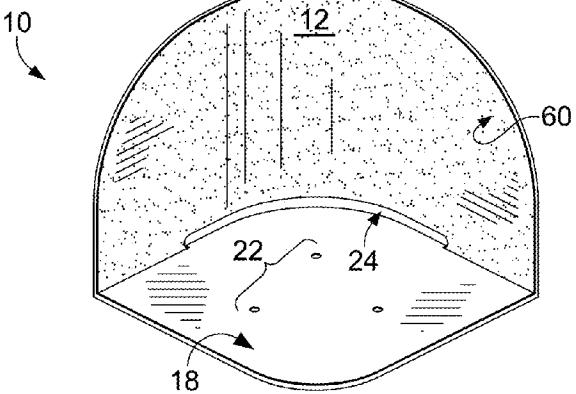
FIG. 2D is an interior perspective view of a textured interior surface of a mattress-retention mechanism.

Another exemplary mattress-retention mechanism 10 is depicted in FIG. 2D, with an interior perspective view of a textured interior surface 60 of the mattress-retention mechanism 10. The textured interior surface 60 may be used to further restrict movement of a mattress 16 during articulation of an automated bed. As will be understood, a variety of techniques, materials, or mechanisms may be used to create the textured interior surface 60. For example, a series of indentations may be integrated into a cast for the mattress-retention mechanism 10, such that the molded mechanism may include raised bumps that protrude from the curved interior surface 14. In further examples, a series of cross-hatched ridges may be incorporated into the mattress-retention mechanism 10 mold, thereby creating a grid-like texture on the curved interior surface 14. Any number of patterns, or any amount of texture, may be incorporated into the textured interior surface 60, which may also be applied to some or all of the curved interior surface 14. Additionally, a texture may also be applied to the foundation attachment surface 18, so as to further secure a mattress 16 retained against the interior of the mattress-support structure 12.

Figure 3A:
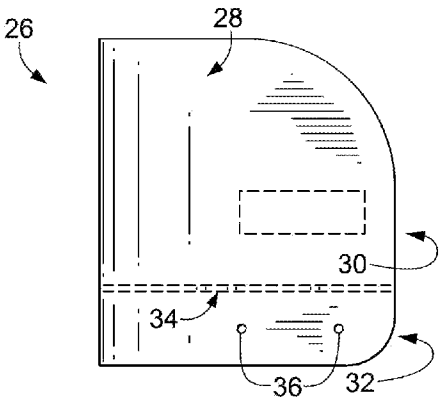
FIG. 3A is a side view of a mattress-retention mechanism.
Figure 3B:
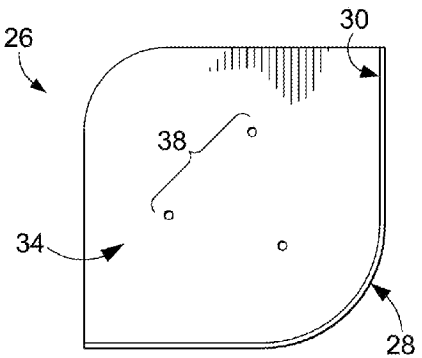
FIG. 3B is a top view of the mattress-retention mechanism of FIG. 3A.

Referring next to FIG. 3A, a side view of a mattress-retention mechanism 26 includes a mattress-support structure 28 having curved interior surfaces 30 and 32, a foundation attachment surface 34, and side attachment surface mechanisms 36. In embodiments, when used to retain a mattress 16 during articulation of an automated bed, curved interior surface 30 conforms to the vertical corner of a mattress 16, while curved interior surface 32 conforms to the vertical corner of a mattress foundation 20. Additionally, side attachment surface mechanisms 36 may be used to attach the mattress-retention mechanism 26 to a mattress foundation 20. FIG. 3B depicts the thickness of the mattress-support structure 28, having a curved interior surface 30, as viewed from the top. In embodiments, mattress-support structure 28 has a thickness between 0.09 and 0.13 inches. In one example, foundation attachment surface 34 includes foundation attachment mechanisms 38, which may be used in addition to or instead of side attachment mechanisms 36. Foundation attachment surface 34 may also have a thickness between 0.09 and 0.13 inches. As discussed with reference to attachment mechanisms 22, any number of type of side attachment mechanisms 36 and/or foundation attachment mechanisms 38 may be used to secure mattress-retention mechanism 26, including screws, bolts, posts, pegs, hooks, or other devices.

Figure 3C:
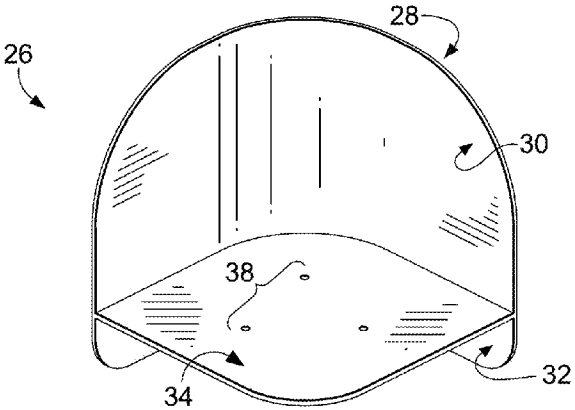
FIG. 3C is an interior perspective view of the mattress-retention mechanism of FIG. 3A.
Figure 3D:
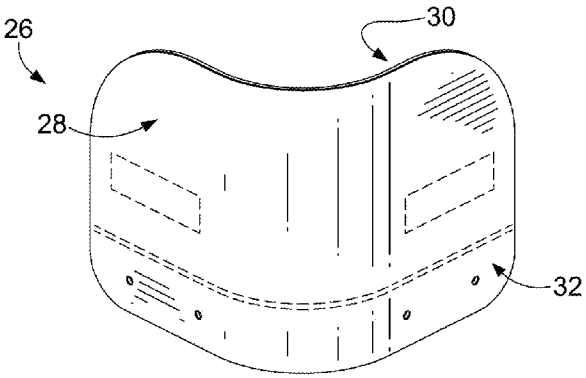
FIG. 3D is an exterior perspective view of the mattress-retention mechanism of FIG. 3A.

FIG. 3C is an interior perspective view of exemplary mattress-retention mechanism 26, demonstrating the curved interior surfaces 30 and 32 of the mattress-support structure 28. As will be understood, curved interior surface 30 abuts the vertical, curved surface of a mattress 16 positioned above the foundation attachment surface 34, while curved interior surface 32 abuts a mattress foundation 20 positioned below the foundation attachment surface 34. As seen in the exterior perspective view of FIG. 3D, the exterior of mattress-support structure 28 is also curved. Accordingly, having a consistent thickness between the curved interior surface 30 and the exterior surface of the mattress-support structure 28, embodiments of the mattress-retention mechanism 26 have an internal radius of the curved internal surface 30 of approximately 2.5 inches. Embodiments of the mattress-retention mechanism 26 have an internal radius that conforms to the curved edge of the corner of a mattress 16, and the corner of a mattress foundation 20.

Figure 4D:
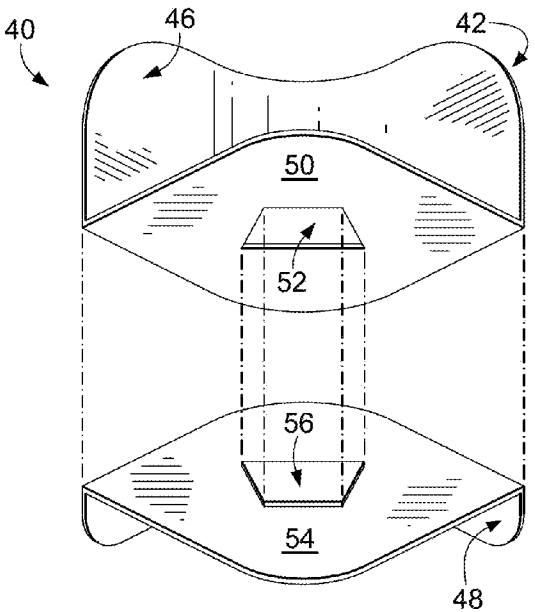
FIG. 4D is an interior perspective view of the mattress-retention component of FIG. 4A, with the upper retaining component and the lower retaining component tilted away from each other to reveal the bottom surface of the upper retaining component and the top surface of the lower retaining component.
Figure 4B:
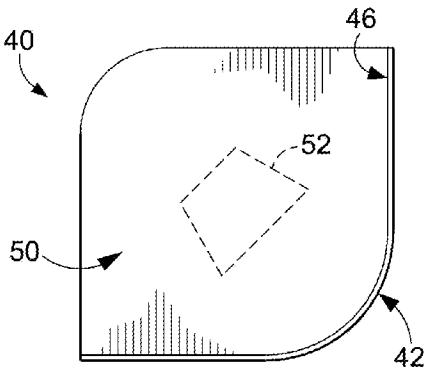
FIG. 4B is a top view of the upper retaining component of the mattress-retention mechanism of FIG. 4A.
Figure 4C:
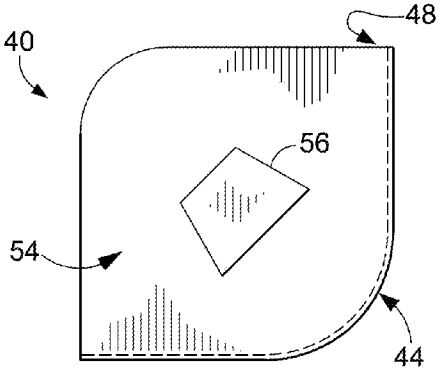
FIG. 4C is a top view of the lower retaining component of the mattress-retention mechanism of FIG. 4A.
Figure 4A:
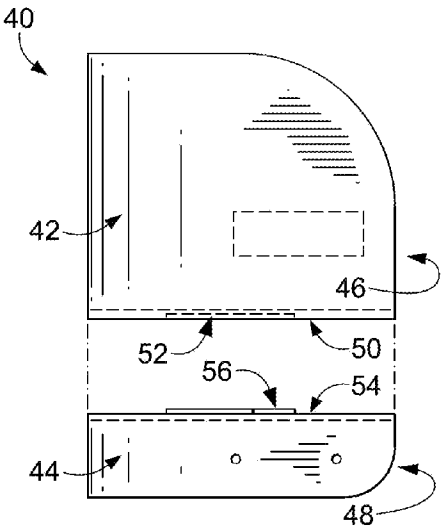
FIG. 4A is a side view of a mattress-retention mechanism, which includes an upper retaining component and a lower retaining component.

Referring next to FIG. 4A, a side view of a mattress-retention mechanism 40 includes an upper retaining component 42 having a curved interior surface 46 and a foundation attachment surface 50 having a lower surface with a lock component 52. The curved interior surface 46 of the upper retaining component 42 is conformed to the vertical curve of a mattress 16. The upper retaining component 42 is capable of coupling to the lower retaining component 44, which includes a top surface 54 having a socket component 56. As will be understood, the curved interior surface 48 of the lower retaining component 44 is conformed to the vertical curve of a mattress foundation 20. Accordingly, the lower retaining component may be attached to a mattress foundation 20 using one or more attachment mechanisms, such as side attachment mechanisms 36.

Embodiments of the upper retaining component 42 and the lower retaining component 44 may be cast from separate molds of the same or different materials. For example, one or both of the upper retaining component 42 and the lower retaining component 44 may be constructed from plastic, metal, or any other material that can maintain the shape of the mattress-retention mechanism 40 while restricting the movement of a mattress 16 during articulation.

In one embodiment, the socket component 56 of the lower retaining component 44 mates with the lock component 52 of the upper retaining component 42, thereby coupling the upper retaining component 42 to the lower retaining component 44. As best depicted in FIG. 4B, the foundation attachment surface 50 has a lower surface with a lock component 52. Although depicted as only a partial indentation into the lower surface of the foundation attachment surface 50, in some embodiments, the lock component 52 may be an aperture in the upper retaining component 42 such that the socket component 56 fits through the lock component 52. As shown in FIG. 4C, the socket component 56 extends from the top surface of the lower retaining component 44, and fits inside the lock component 52.

Turning now to FIG. 4D, an interior perspective view of mattress-retention mechanism 40 demonstrates the coupling of the upper retaining component 42 and the lower retaining component 44, which are tilted away from each other to reveal the socket and lock combination. As will be understood, lock component 52 and socket component 56 may be any shape that couples to each other, and may also be arranged in any orientation on the foundation attachment surface 50 of the upper retaining component 42, and the top surface 54 of the lower retaining component 44. Additionally, in some embodiments, foundation attachment surface 50 includes more than one lock component 52, while top surface 54 includes more than one socket component 56.

Figure 5A:
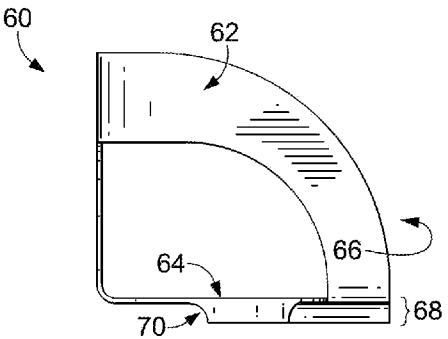
FIG. 5A is a side view of a mattress-retention mechanism.

With reference now to FIG. 5A, a side view of a mattress-retention mechanism 60 includes a mattress-support structure 62, a foundation attachment surface 64, a curved interior surface 66, a spacer extension 68, and a cavity 70. Foundation attachment surface 64 can be used to couple the mattress-retention mechanism 60 to a mattress foundation 20 using one or more attachment mechanisms.

Embodiments of a mattress-retention mechanism 60 may be constructed from polypropylene, ABS, glass-filled nylon, aluminum casting, steel, or any other material that can maintain the shape of the mattress-retention mechanism 60 while restricting the movement of a mattress 16 during articulation. In addition to preventing the mattress 16 from moving towards the foot end of a bed during articulation, embodiments of the mattress-retention mechanism 60 include a cavity 70 created between a mattress foundation 20 and the mattress-retention mechanism 60, which may be used to retain bedding on the mattress 16. As depicted in FIG. 5A, the cavity 70 is created when the spacer extension 68 on the bottom surface of the foundation attachment surface 64 is attached to the top surface of a mattress foundation 20. The cavity 70 is adapted to accommodate bedding inserted through the cavity 70. For example, the corner edge of a fitted bed sheet may be inserted into the cavity 70 to secure the bed sheet to the mattress 16.

In one embodiment, the mattress-retention mechanism 60 may be positioned in direct contact with the mattress 16, with bedding for the mattress 16 secured around the corner of the mattress 16 (and around the mattress-retention mechanism 60) and into the cavity 70. In other embodiments, a fitted sheet may be applied directly to the mattress 16, with the mattress-retention mechanism 60 securing both the mattress 16 and the fitted sheet. In that example, additional bedding may still be inserted into the cavity 70.

Figure 5B:
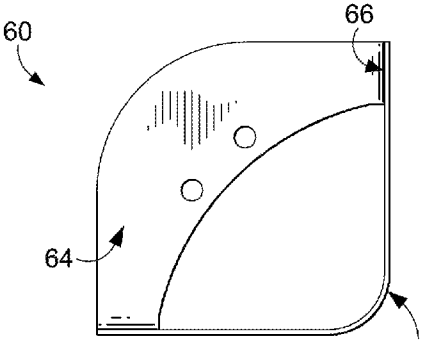
FIG. 5B is a top view of the mattress-retention mechanism of FIG. 5A.
Figure 5C:
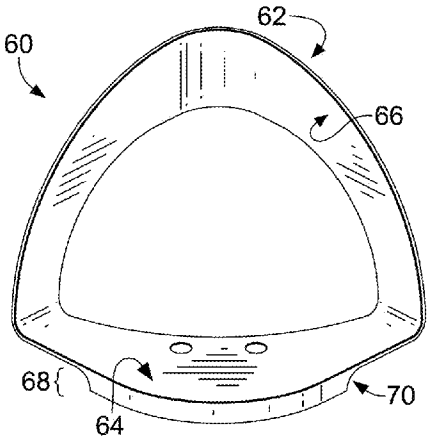
FIG. 5C is an interior perspective view of the mattress-retention mechanism of FIG. 5A.
Figure 5D:
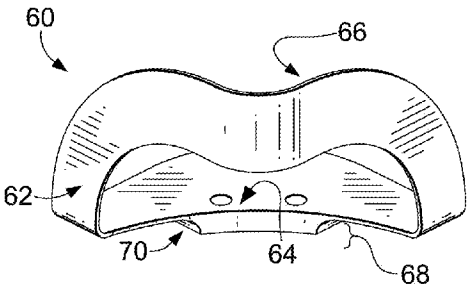
FIG. 5D is an exterior perspective view of the mattress-retention mechanism of FIG. 5A.

Additional views of the mattress-retention mechanism 60 are depicted in FIGS. 5B-5D. FIG. 5B is an top view of an exemplary mattress-retention mechanism 60, including a curved interior surface 66 of the mattress-support structure 62 that abuts to the vertical side of a mattress 16. The top of the foundation attachment surface 64 is depicted in FIG. 5B as including apertures in the surface that can be used to attach the mattress-retention mechanism 60 to a mattress foundation 20.

FIG. 5C is an interior perspective view of the mattress-retention mechanism of FIG. 5A, which demonstrates the curved interior surface 66 of the mattress-support structure. In some embodiments, the thickness of spacer extension 68 is increased or decreased to increase or decrease the amount of space between the bottom of a mattress 16 (retained by the mattress-retention mechanism 60) and a mattress foundation 20, thereby creating a larger or smaller cavity 70. Spacer extension 68 may be the same material as the mattress-support structure, or a different material. In some embodiments, spacer extension 68 is cast separately and attached to the foundation attachment surface 64, while in other embodiments spacer extension 68 is integrated into the same mold as the mattress-support structure 62.

As viewed in both FIGS. 5C and 5D, cavity 70 extends around the body of the mattress-retention mechanism 60, underneath at least a portion of the foundation attachment surface 64. Accordingly, bedding may be inserted into a cavity 70 created between the bottom of a mattress 16 and top of a mattress foundation 20.

From the foregoing, it will be seen that this invention is one well adapted to attain all the ends and objects hereinabove set forth together with other advantages, which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

The invention claimed is:

1. A mattress-retention mechanism, comprising:

a mattress-support structure adapted to support at least one corner of a mattress, at least a portion of the mattress-support structure having a curved interior surface;

a foundation attachment surface for removably attaching the mattress-retention mechanism to a top of a mattress foundation, wherein the foundation attachment surface is perpendicular to the curved interior surface; and a bedding cavity positioned in a side surface of the mattress-support structure, the bedding cavity adapted to accommodate bedding inserted through the bedding cavity.

2. The mattress-retention mechanism of claim 1, wherein the curved interior surface conforms to a curve of a vertical side of the mattress.

3. The mattress-retention mechanism of claim 1, wherein the mattress-support structure is molded in a single piece.

4. The mattress-retention mechanism of claim 1, further comprising:

a side attachment surface for removably attaching the mattress-retention mechanism to a vertical side of the mattress foundation, the side attachment surface perpendicular to the foundation attachment surface.

5. The mattress-retention mechanism of claim 1, wherein the mattress-retention mechanism is molded in a single piece.

6. The mattress-retention mechanism of claim 1, wherein the foundation attachment surface comprises a spacer extension.

7. The mattress-retention mechanism of claim 1, wherein an exterior surface of the mattress-retention mechanism comprises an identifying marking molded into the exterior surface of the mattress-retention mechanism.

8. A mattress-retention mechanism, comprising:

an upper retaining component comprising:

(1) a mattress-support structure adapted to support at least one corner of a mattress, at least a portion of the mattress-support structure having a curved interior surface; and (2) a foundation attachment surface perpendicular to the curved interior surface, wherein the foundation attachment surface comprises a lock component imbedded in a lower surface of the foundation attachment surface; and a lower retaining component comprising a socket component that protrudes from a top surface of the lower retaining component, wherein the lower retaining component is removably attached to a top of a mattress foundation, wherein the socket component of the lower retaining component is capable of mating with the lock component of the foundation attachment surface, thereby coupling the upper retaining component to the lower retaining component.

9. The mattress-retention mechanism of claim 8, wherein the lower retaining component comprises a side attachment surface for removably attaching the mattress-retention mechanism to a vertical side of the mattress foundation, the side attachment surface perpendicular to the top surface of the lower retaining component.

10. The mattress-retention mechanism of claim 8, further comprising a bedding aperture positioned in a side surface of the mattress-support structure, the bedding aperture adapted to accommodate bedding inserted through the bedding aperture.

11. The mattress-retention mechanism of claim 10, wherein the bedding comprises at least one bed sheet.

12. The mattress-retention mechanism of claim 8, wherein an exterior surface of the mattress-retention mechanism comprises an identifying marking molded into the exterior surface of the mattress-retention mechanism.

13. A mattress-retention mechanism, comprising:

a mattress-support structure adapted to support at least one corner of a mattress, at least a portion of the mattress-support structure having a curved interior surface, wherein the curved interior surface conforms to a curve of a vertical side of the mattress;

a foundation attachment surface for removably attaching the mattress-retention mechanism to a top of a mattress foundation, wherein the foundation attachment surface is perpendicular to the curved interior surface; and a bedding aperture positioned in a side surface of the mattress-support structure, the bedding aperture adapted to accommodate bedding inserted through the bedding aperture.

14. The mattress-retention mechanism of claim 13, further comprising a side attachment surface for removably attaching the mattress-retention mechanism to a vertical side of the mattress foundation, the side attachment surface perpendicular to the foundation attachment surface.

15. The mattress-retention mechanism of claim 13, wherein the bedding comprises at least one bed sheet.

16. The mattress-retention mechanism of claim 13, wherein an exterior surface of the mattress-retention mechanism comprises an identifying marking molded into the exterior surface of the mattress-retention mechanism.

17. The mattress-retention mechanism of claim 13, wherein at least one of the curved interior surface and the foundation attachment surface comprises a textured surface, said textured surface adapted to restrict movement of the mattress.

18. The mattress-retention mechanism of claim 17, wherein the textured surface comprises one or more of a plurality of raised bumps and a plurality of cross-hatched ridges that provide a grid-like texture.

19. The mattress-retention mechanism of claim 13, wherein the mattress-retention mechanism is molded in a single piece.

20. The mattress-retention mechanism of claim 13, wherein the foundation attachment surface comprises a plurality of attachment mechanism for removably attaching the mattress-retention mechanism to the top of the mattress foundation.

* * * * *